US010561891B2

(12) United States Patent
Luger et al.

(10) Patent No.: US 10,561,891 B2
(45) Date of Patent: Feb. 18, 2020

(54) EXERCISE MACHINE

(71) Applicant: Octane Fitness, LLC, Brooklyn Park, MN (US)

(72) Inventors: Nathan R. Luger, Roseville, MN (US); Charles J. Rosenow, Ramsey, MN (US)

(73) Assignee: Nautilus, Inc., Vancouver, WA (US)

( * ) Notice: Subject to any disclaimer, the term of this patent is extended or adjusted under 35 U.S.C. 154(b) by 203 days.

(21) Appl. No.: 15/606,754

(22) Filed: May 26, 2017

(65) Prior Publication Data

US 2018/0339189 A1 Nov. 29, 2018

(51) Int. Cl.
*A63B 22/00* (2006.01)
*A63B 21/00* (2006.01)
(Continued)

(52) U.S. Cl.
CPC ..... *A63B 22/0046* (2013.01); *A63B 21/0052* (2013.01); *A63B 21/00076* (2013.01); *A63B 21/0088* (2013.01); *A63B 21/012* (2013.01); *A63B 21/4034* (2015.10); *A63B 21/4035* (2015.10); *A63B 22/001* (2013.01); *A63B 22/0015* (2013.01); *A63B 22/0017* (2015.10); *A63B 22/0664* (2013.01);
(Continued)

(58) Field of Classification Search
None
See application file for complete search history.

(56) References Cited

U.S. PATENT DOCUMENTS 1,219,439 A 9/1879 Blend
3,134,378 A 5/1964 Harwood
(Continued)

FOREIGN PATENT DOCUMENTS

EP 0323056 A2 7/1989
EP 2383020 A1 11/2011
(Continued)

OTHER PUBLICATIONS

PCT International Search Report and Written Opinion, PCT Application No. PCT/US2018/033925 dated Aug. 9, 2018, 12 pages.
(Continued)

*Primary Examiner* — Stephen R Crow
(74) *Attorney, Agent, or Firm* — Dorsey & Whitney LLP

(57) ABSTRACT

A stationary exercise machine may include reciprocating hand members, such as handles, and/or reciprocating foot members, such as foot pedals. The reciprocating hand members may be operative to apply a first moment to a crankshaft, and the reciprocating foot members may be operative to apply a second moment to the crankshaft. The second moment may be different than the first moment. The reciprocating foot members may cause a user's feet to move along a closed loop path that is substantially inclined, such that the user's foot motion simulates a climbing motion more than a flat walking or running motion. The reciprocating hand members may be configured to move in coordination with the foot members via a linkage operatively coupling the hand members with the foot members. A resistance mechanism may apply resistance to crankshaft rotation, and the resistance mechanism may be adjustable while the user is using the machine.

20 Claims, 8 Drawing Sheets

(51) Int. Cl.

| | |
|---|---|
| ***A63B 21/005*** | (2006.01) |
| ***A63B 21/008*** | (2006.01) |
| ***A63B 21/012*** | (2006.01) |
| ***A63B 22/06*** | (2006.01) |
| ***A63B 23/035*** | (2006.01) |
| ***A63B 71/06*** | (2006.01) |
| ***A63B 22/20*** | (2006.01) |

(52) U.S. Cl.

CPC ..... *A63B 22/205* (2013.01); *A63B 23/03575* (2013.01); *A63B 23/03583* (2013.01); *A63B 71/0619* (2013.01); *A63B 21/005* (2013.01); *A63B 21/0051* (2013.01); *A63B 21/00069* (2013.01); *A63B 2022/0676* (2013.01)

(56) References Cited

U.S. PATENT DOCUMENTS

| | | | | |
|---|---|---|---|---|
| 3,213,852 | A | 10/1965 | Zent | |
| 3,964,742 | A | 6/1976 | Carnielli | |
| 4,880,225 | A | 11/1989 | Lucas et al. | |
| 5,048,824 | A | 9/1991 | Chen | |
| 5,051,638 | A | 9/1991 | Pyles | |
| 5,242,343 | A | 9/1993 | Miller | |
| 5,290,211 | A | 3/1994 | Stearns | |
| 5,290,212 | A | 3/1994 | Metcalf | |
| 5,383,829 | A | 1/1995 | Miller | |
| 5,499,956 | A | 3/1996 | Habing et al. | |
| 5,518,473 | A | 5/1996 | Miller | |
| 5,529,555 | A | 6/1996 | Rodgers, Jr. | |
| 5,540,637 | A | 7/1996 | Rodgers | |
| 5,549,526 | A | 8/1996 | Rodgers, Jr. | |
| 5,562,574 | A | 10/1996 | Miller | |
| 5,573,480 | A | 11/1996 | Rodgers, Jr. | |
| 5,577,985 | A | 11/1996 | Miller | |
| 5,593,371 | A | 1/1997 | Rodgers, Jr. | |
| 5,593,372 | A | 1/1997 | Rodgers, Jr. | |
| 5,595,553 | A | 1/1997 | Rodgers, Jr. | |
| 5,611,758 | A | 3/1997 | Rodgers, Jr. | |
| 5,653,662 | A | 8/1997 | Rodgers, Jr. | |
| 5,683,330 | A | 11/1997 | Kobayashi | |
| 5,685,804 | A | 11/1997 | Whan-Tong et al. | |
| 5,690,589 | A | 11/1997 | Rodgers, Jr. | |
| 5,707,321 | A | 1/1998 | Maresh | |
| 5,738,614 | A | 4/1998 | Rodgers, Jr. | |
| 5,743,834 | A | 4/1998 | Rodgers, Jr. | |
| 5,795,270 | A | 8/1998 | Woods et al. | |
| 5,836,855 | A | 11/1998 | Eschenbach | |
| 5,997,445 | A | 12/1999 | Maresh et al. | |
| 6,019,710 | A | 2/2000 | Dalebout et al. | |
| 6,024,676 | A | 2/2000 | Eschenbach | |
| 6,206,806 | B1 | 3/2001 | Chu | |
| 6,422,977 | B1 | 7/2002 | Eschenbach | |
| D512,112 | S | 11/2005 | Nagano | |
| 7,086,993 | B1 | 8/2006 | Maresh | |
| 7,201,705 | B2 | 4/2007 | Rodgers, Jr. | |
| 7,238,146 | B1 | 7/2007 | Chen | |
| D559,925 | S | 1/2008 | Horita | |
| D565,129 | S | 3/2008 | Chang et al. | |
| D567,310 | S | 4/2008 | Chen et al. | |
| D567,314 | S | 4/2008 | Horita | |
| 7,377,879 | B1 | 5/2008 | Chen | |
| D575,363 | S | 8/2008 | Horita | |
| 7,448,986 | B1 | 11/2008 | Porth | |
| 7,455,624 | B2 | 11/2008 | Liao Lai | |
| 7,462,134 | B2 | 12/2008 | Lull et al. | |
| 7,556,591 | B2 | 7/2009 | Chuang et al. | |
| 7,591,761 | B1 | 9/2009 | Ellis | |
| 7,611,446 | B2 | 11/2009 | Chuang et al. | |
| 7,618,350 | B2 | 11/2009 | Dalebout et al. | |
| D606,599 | S | 12/2009 | Murray et al. | |
| 7,666,122 | B2 | 2/2010 | Chiles et al. | |
| 7,674,205 | B2 | 3/2010 | Dalebout et al. | |
| 7,736,278 | B2 | 6/2010 | Lull et al. | |
| 7,785,235 | B2 | 8/2010 | Lull et al. | |
| 7,789,808 | B2 | 9/2010 | Lee et al. | |
| 7,811,206 | B2 * | 10/2010 | Chuang | A63B 22/001 482/52 |
| D703,278 | S | 4/2014 | Horita | |
| 8,734,298 | B2 | 5/2014 | Murray | |
| 8,926,478 | B2 | 1/2015 | Huang et al. | |
| 8,979,713 | B2 | 3/2015 | Huang et al. | |
| 9,056,217 | B2 | 6/2015 | Kao et al. | |
| 9,061,174 | B2 | 6/2015 | Jun | |
| 9,199,115 | B2 | 12/2015 | Yim et al. | |
| 9,254,414 | B2 | 2/2016 | Liu et al. | |
| 9,468,797 | B1 | 10/2016 | Miller | |
| 9,987,513 | B2 | 6/2018 | Yim et al. | |
| 2003/0096677 | A1 | 5/2003 | Chu | |
| 2005/0181911 | A1 | 8/2005 | Porth | |
| 2005/0181912 | A1 * | 8/2005 | Eschenbach | A63B 21/154 482/52 |
| 2006/0079381 | A1 | 4/2006 | Cornejo et al. | |
| 2006/0166791 | A1 | 7/2006 | Liao et al. | |
| 2006/0172865 | A1 | 8/2006 | Dey et al. | |
| 2006/0293153 | A1 | 12/2006 | Porth et al. | |
| 2007/0087906 | A1 * | 4/2007 | Rodgers, Jr. | A63B 21/05 482/52 |
| 2007/0117683 | A1 | 5/2007 | Ercanbrack et al. | |
| 2007/0129219 | A1 | 6/2007 | Mahleberg | |
| 2007/0232457 | A1 * | 10/2007 | Porth | A63B 22/001 482/51 |
| 2007/0254778 | A1 | 11/2007 | Ashby | |
| 2008/0161163 | A1 | 7/2008 | Stewart et al. | |
| 2008/0207400 | A1 | 8/2008 | Liao Lai | |
| 2008/0220947 | A1 | 9/2008 | Meng | |
| 2008/0280731 | A1 | 11/2008 | Dalebout et al. | |
| 2009/0011904 | A1 | 1/2009 | Chuang et al. | |
| 2009/0048077 | A1 * | 2/2009 | Chuang | A63B 22/001 482/62 |
| 2009/0093346 | A1 | 4/2009 | Nelson et al. | |
| 2009/0124463 | A1 | 5/2009 | Chen | |
| 2009/0203501 | A1 | 8/2009 | Rodgers, Jr. | |
| 2009/0312156 | A1 | 12/2009 | Chen et al. | |
| 2010/0167877 | A1 | 7/2010 | Grind | |
| 2010/0190613 | A1 | 7/2010 | Murray et al. | |
| 2010/0234185 | A1 | 9/2010 | Watt et al. | |
| 2012/0088635 | A1 | 4/2012 | Lee et al. | |
| 2013/0012363 | A1 | 1/2013 | Eschenbach | |
| 2013/0085042 | A1 | 4/2013 | Huang | |
| 2013/0237379 | A1 | 9/2013 | Huang et al. | |
| 2014/0194253 | A1 | 7/2014 | Huang et al. | |
| 2014/0248998 | A1 | 9/2014 | Lu et al. | |
| 2014/0274575 | A1 | 9/2014 | Yim et al. | |
| 2015/0238809 | A1 | 8/2015 | Huang et al. | |
| 2016/0008658 | A1 | 1/2016 | Yim et al. | |
| 2016/0082308 | A1 | 3/2016 | Yim et al. | |
| 2017/0056709 | A1 | 3/2017 | Ercanbrack et al. | |
| 2017/0056717 | A1 | 3/2017 | Ercanbrack et al. | |
| 2018/0250550 | A1 | 9/2018 | Yim et al. | |

FOREIGN PATENT DOCUMENTS

| | | | |
|---|---|---|---|
| WO | 2009026604 | A2 | 3/2009 |
| WO | 2014145981 | A1 | 9/2014 |

OTHER PUBLICATIONS

"PCT International Search Report", PCT International Search Report dated Aug. 20, 2014 for International Application No. PCT/US2014/030845, 2 pages.

"PCT International Search Report and Written Opinion", PCT International Search Report and Written Opinion dated Nov. 18, 2014 for International Application No. PCT/US2014/031119, 18 pages.

"PCT International Search Report and Written Opinion", PCT International Search Report and Written Opinion dated Oct. 14, 2014, Application No. PCT/US2014/030875, 13 pages.

"PCT Written Opinion", PCT Written Opinion dated Aug. 20, 2014 for International Application No. PCT/US2014/030845, 7 pages.

Bowflex, "Bowflex Max Trainer M7", YouTube, https://www.

(56) References Cited

OTHER PUBLICATIONS youtube.com/watch?v=VaeRjre0RIM [Retrieved form the internet on Nov. 4, 2016], Feb. 5, 2016, 4 Pages.

* cited by examiner

EXERCISE MACHINE

TECHNICAL FIELD

This application relates generally to stationary exercise machines having reciprocating members.

BACKGROUND

Certain stationary exercise machines with reciprocating leg and/or arm portions have been developed. Such stationary exercise machines include stair climbers and elliptical trainers, each of which typically offers a different type of workout. For example, a stair climber may provide a lower frequency vertical climbing simulation while an elliptical trainer may provide a higher frequency horizontal running simulation. Additionally, these machines may include handles that provide support for the user's arms during exercise. However, the connection between the handles and the leg portions of traditional stationary exercise machines may not enable sufficient exercise of the user's body. It may therefore be desirable to provide an improved stationary exercise machine which addresses one or more of the problems in the field and which generally improves the user experience.

SUMMARY

This application generally provides a stationary exercise machine. In accordance with the present disclosure, a stationary exercise machine may include a frame, a crankshaft coupled with the frame and rotatable about a crankshaft axis, first and second crank arms rigidly coupled with respective opposite sides of the crankshaft, wherein rotation of at least one of the first or second crank arms causes rotation of the crankshaft about the crankshaft axis, first and second intermediate crank arms rigidly coupled with the first and second crank arms, respectively, and first and second handles operatively coupled with the first and second intermediate crank arms, respectively, at respective pivot axes to convert a user's input force at the first and second handles into a moment on the crankshaft, wherein the respective pivot axes are spaced a distance from the crankshaft axis and orbit the crankshaft axis to define respective virtual crank arms extending between the respective pivot axes and the crankshaft axis.

In some examples, the first and second intermediate crank arms are angularly offset from the first and second crank arms, respectively, to define an angle between the first and second intermediate crank arms and the first and second crank arms, respectively.

In some examples, the angle comprises about 15 degrees.

In some examples, the stationary exercise machine further includes first and second upper reciprocating members pivotally coupled with the first and second intermediate crank arms, respectively, at the respective pivot axes and pivotally coupled with the first and second handles, respectively. In some examples, the first and second intermediate crank arms are positioned laterally inside of the first and second upper reciprocating members, and the first and second crank arms are positioned laterally inside of the first and second intermediate crank arms. In some examples, the first and second upper reciprocating members are pivotally coupled with first and second extensions of the first and second handles, respectively. In some examples, the first and second upper reciprocating members comprise first and second rigid links, respectively.

In some examples, the moment comprises a first moment and the respective pivot axes comprise respective first pivot axes, and further comprising first and second pedals operatively coupled with the first and second crank arms, respectively, at respective second pivot axes to convert a user's input force at the first and second pedals into a second moment on the crankshaft. In some examples, the second moment is larger than the first moment. In some examples, the stationary exercise machine further includes first and second lower reciprocating members pivotally coupled with the first and second crank arms, respectively, at the respective second pivot axes, and coupled with the first and second pedals, respectively, at a location distal from the respective second pivot axes. In some examples, the first and second lower reciprocating members are positioned laterally between the first and second crank arms and the first and second intermediate crank arms, respectively. In some examples, the stationary exercise machine further includes first and second inclined members coupled with the frame, and first and second pairs of rollers coupled with the first and second lower reciprocating members, respectively, wherein the first and second pairs of rollers travel along a length of the first and second inclined members, respectively. In some examples, the first and second pairs of rollers each include first and second rollers coupled together with an axle, and the first and second rollers of the first and second pairs of rollers travel along separate inclined members of the first and second inclined members, respectively.

In some examples, the first and second crank arms each include a first end rigidly coupled with the crankshaft and a second end spaced from the crankshaft axis, and the first and second intermediate crank arms each include a first end rigidly coupled with the second end of a respective crank arm of the first and second crank arms, and a second end defining a respective pivot axis of the respective pivot axes. In some examples, the stationary exercise machine further includes first and second upper reciprocating members each including a first end pivotally coupled with the second end of a respective intermediate crank arm of the first and second intermediate crank arms, and a second end pivotally coupled to a respective handle of the first and second handles. In some examples, the stationary exercise machine further includes first and second lower reciprocating members each including a forward end pivotally coupled with the second end of a respective crank arm of the first and second crank arms and the first end of a respective intermediate crank arm of the first and second intermediate crank arms. In some examples, the forward ends of the first and second lower reciprocating members are positioned laterally between the second ends of the first and second crank arms and the first ends of the first and second intermediate crank arms, respectively. In some examples, the stationary exercise machine further includes first and second pedals coupled with rearward ends of the first and second lower reciprocating members, respectively.

In some examples, the stationary exercise machine further includes a resistance mechanism operatively coupled with the crankshaft to resist rotation of the crankshaft about the crankshaft axis.

In accordance with the present disclosure, a stationary exercise machine may include a frame, a crankshaft coupled with the frame and rotatable about a crankshaft axis, first and second handles pivotally coupled with the frame at a handle pivot axis, first and second upper reciprocating members pivotally coupled with the first and second handles, respectively, at first pivot axes offset from the handle pivot axis, first and second intermediate crank members pivotally coupled with the first and second reciprocating members, respectively, at reciprocating axes that orbit the crankshaft axis and define virtual crank arms extending between the crankshaft axis and the reciprocating axes, first and second crank arms fixedly coupled with the first and second intermediate crank members, respectively, at crank axes, the first and second crank arms positioned laterally inside of the first and second intermediate crank members, respectively, and fixedly coupled with the crankshaft, first and second lower reciprocating members pivotally coupled with the first and second crank arms, respectively, and the first and second intermediate crank arms, respectively, at the crank axes, and first and second foot pedals coupled with the first and second lower reciprocating members, wherein the first and second handles are operatively coupled with the first and second intermediate crank arms, respectively, to convert a user's input force at the first and second handles into a first moment on the crankshaft, and the first and second foot pedals are operatively coupled with the first and second crank arms, respectively, to convert a user's input force at the first and second foot pedals into a second moment on the crankshaft that is different than the first moment.

BRIEF DESCRIPTION OF THE DRAWINGS

The description will be more fully understood with reference to the following figures, in which components may not be drawn to scale, which are presented as various embodiments of the exercise machine described herein and should not be construed as a complete depiction of the scope of the exercise machine.

DETAILED DESCRIPTION

Figure 1:
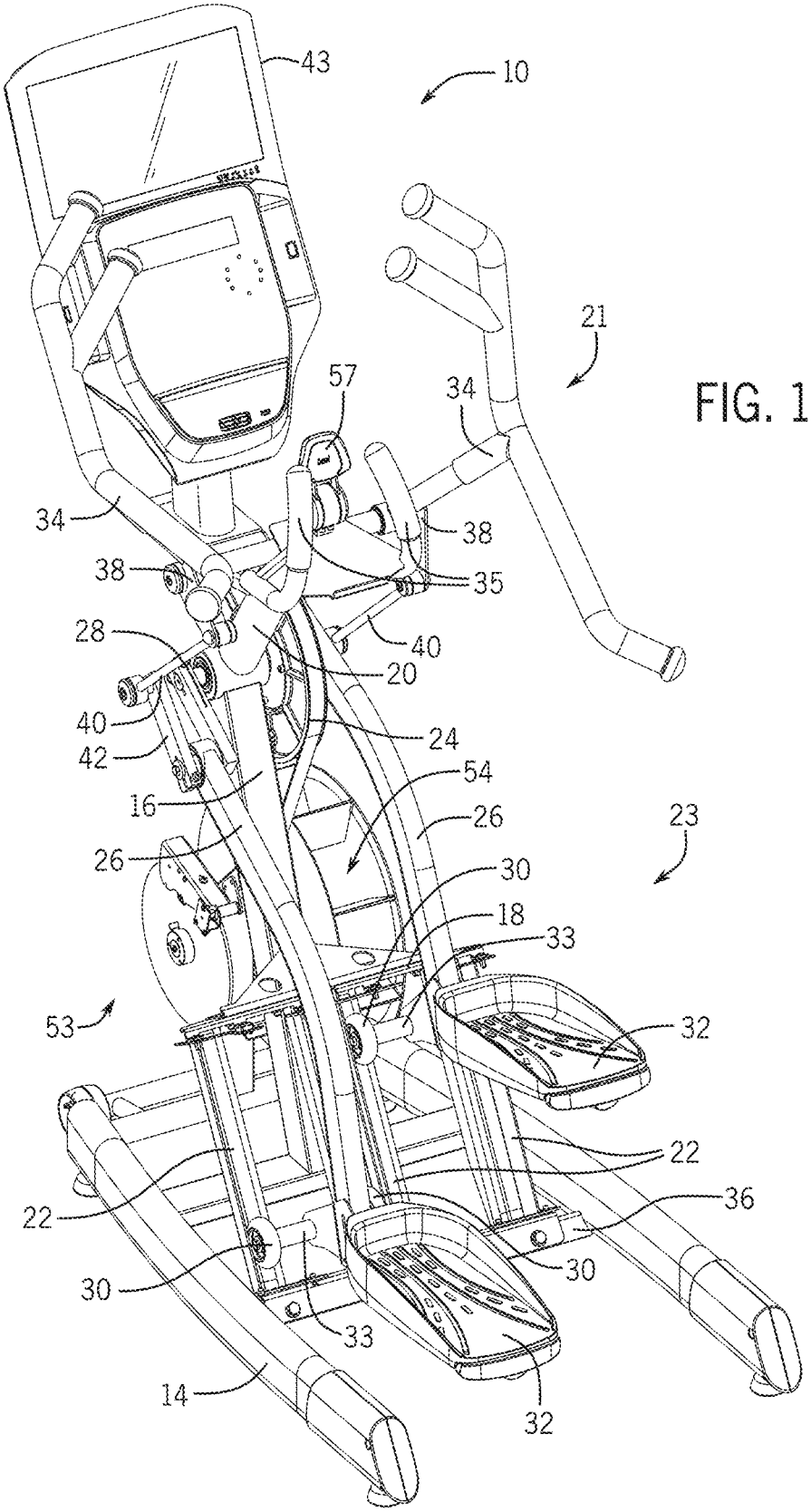
FIG. 1 is a perspective view of an exemplary exercise machine.
Figure 2B:
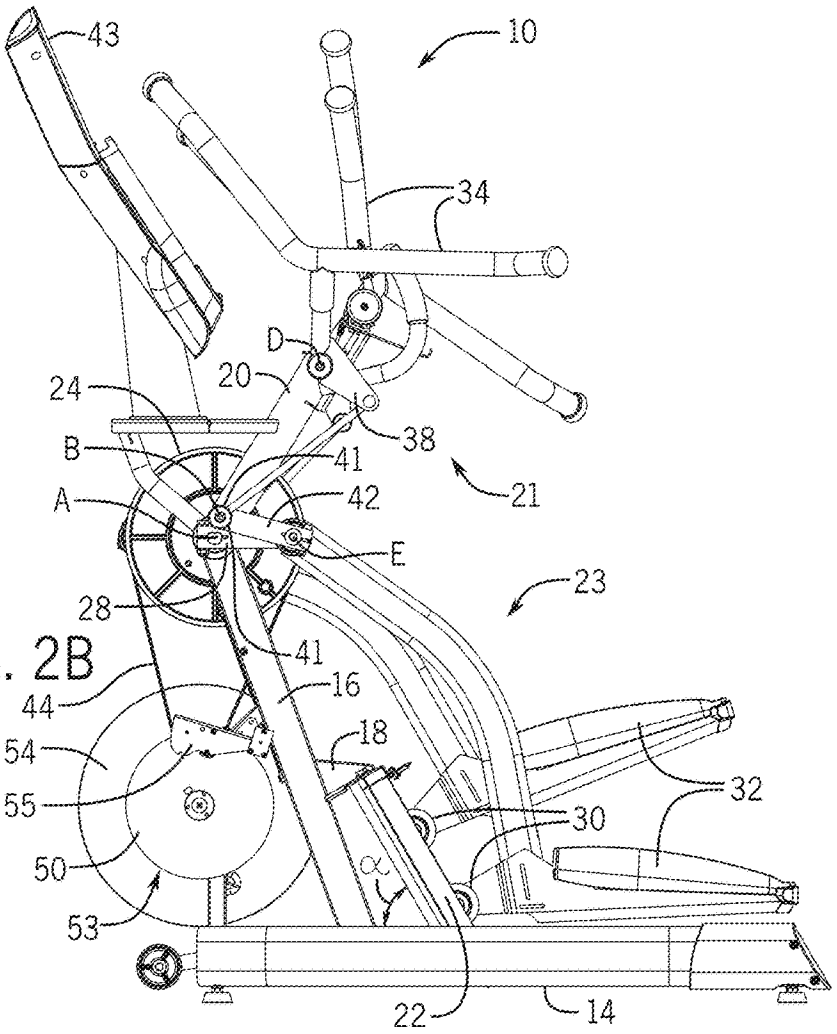
FIGS. 2A-2D are left side views of the machine of FIG. 1, showing different stages of a crank cycle.
Figure 2A:
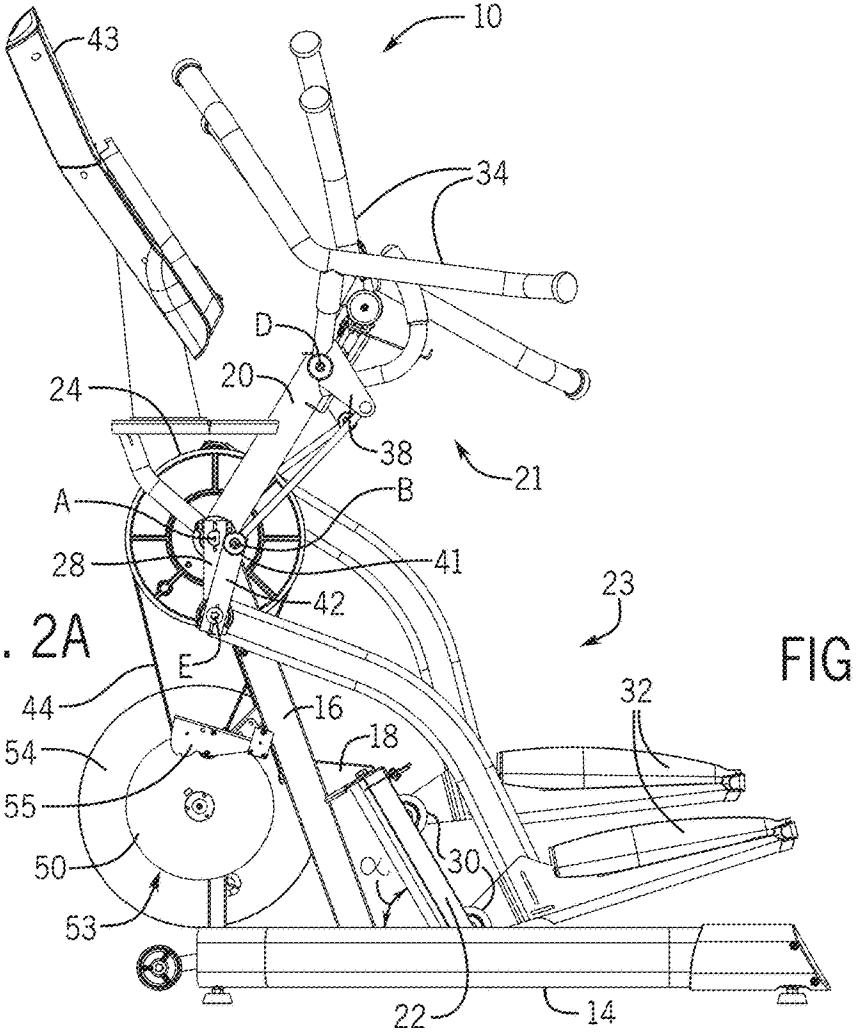
Figure 2D:
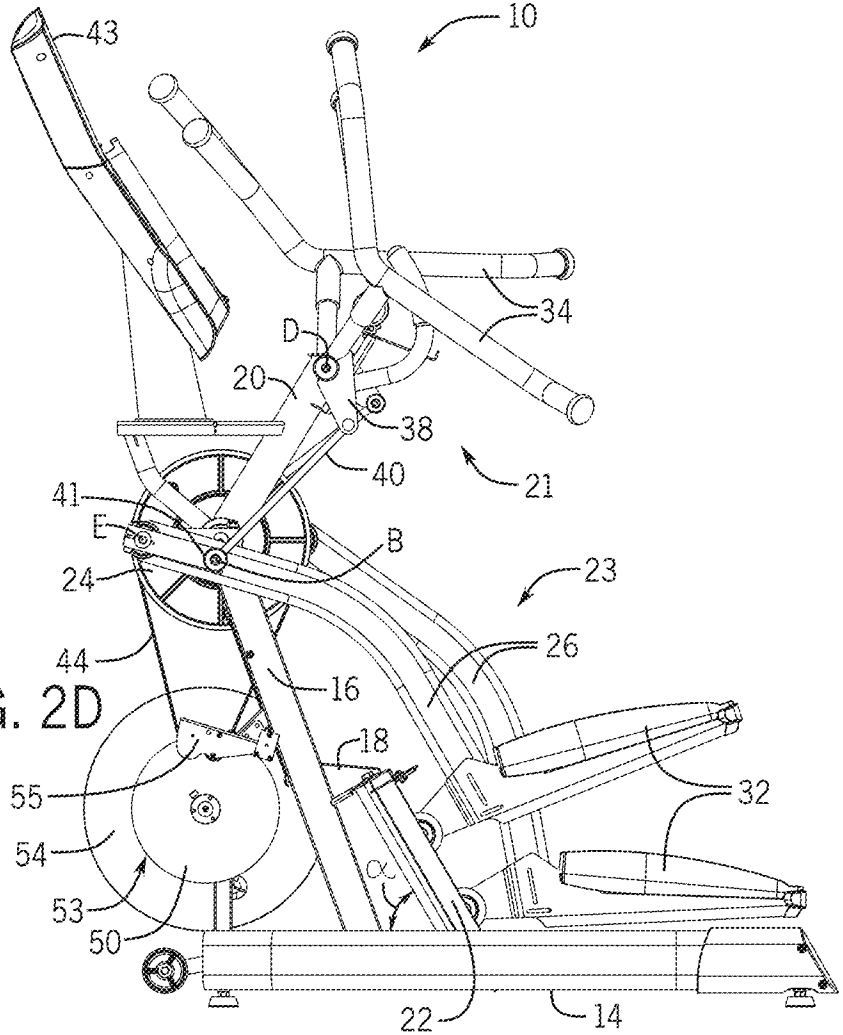
Figure 2C:
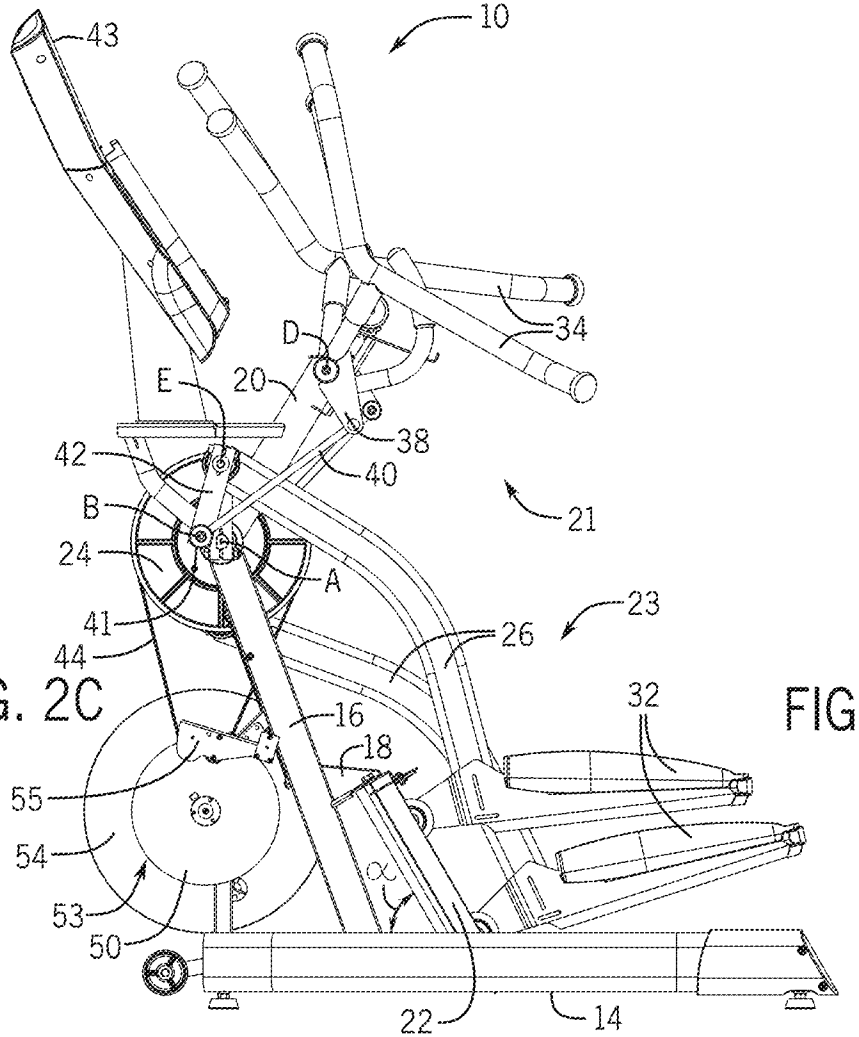
Figure 3:
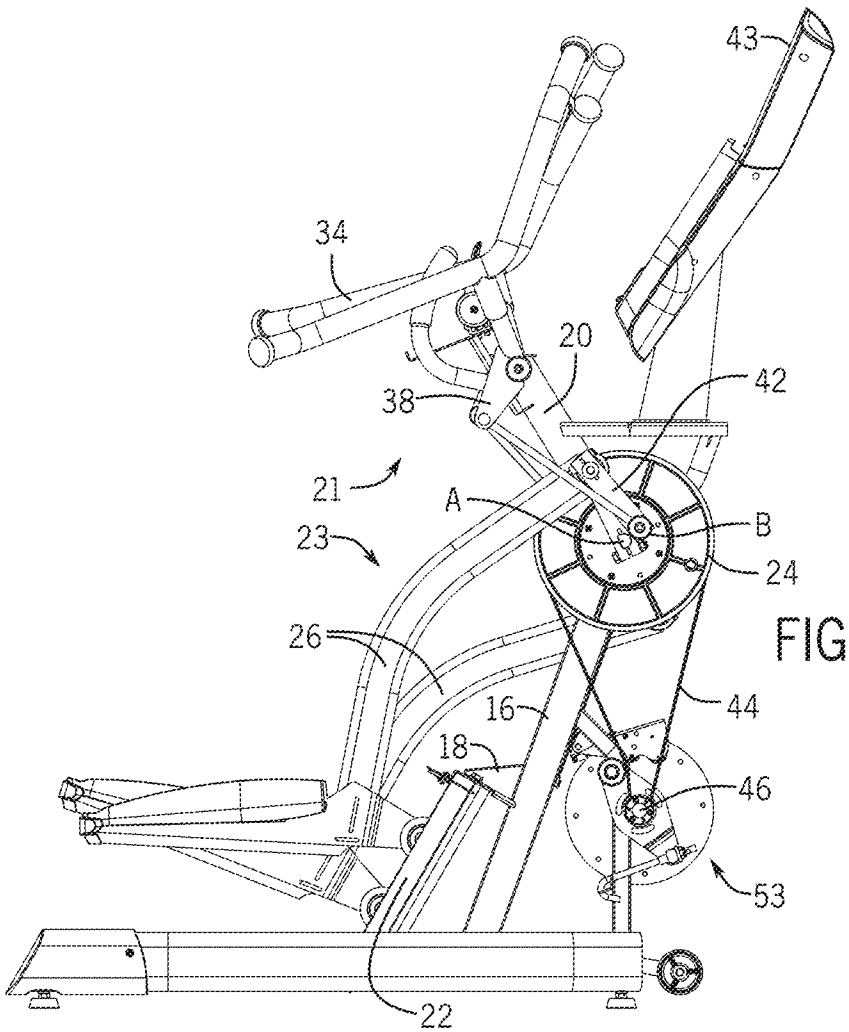
FIG. 3 is a partial right side view of the machine of FIG. 1.

Described herein are embodiments of stationary exercise machines having reciprocating foot and/or hand members, such as foot pedals that move in a closed loop path. The disclosed machines may provide variable resistance against the reciprocal motion of a user, such as to provide for variable-intensity interval training. Some embodiments may include reciprocating foot pedals that cause a user's feet to move along a closed loop path that is substantially inclined, such that the foot motion simulates a climbing motion more than a flat walking or running motion. Some embodiments may include hand members that are configured to move in coordination with the foot pedals and allow the user to exercise upper body muscles. Resistance to the hand members may be proportional to resistance to the foot pedals. Variable resistance may be provided via a rotating air-resistance based fan-like mechanism, via a magnetism based eddy current mechanism, via friction based brakes, and/or via other mechanisms, one or more of which may be rapidly adjusted while the user is using the machine to provide variable intensity interval training.

FIGS. 1-7A show an exemplary embodiment of an exercise machine 10. The machine 10 may include a frame 12, and the frame 12 may include a base 14 for contact with a support surface, a lower support structure 16 extending from the base 14 to an upper support structure 20, and inclined members 22 that extend between the base 14 and the lower support structure 16. A cross brace 18 may connect the inclined members 22 to the lower support structure 16. The various components shown in FIGS. 1-7A are merely illustrative, and other variations, including eliminating components, combining components, rearranging components, and substituting components are all contemplated.

As reflected in the various embodiments described herein, the machine 10 may include an upper moment-producing mechanism 21. The machine may also or alternatively include a lower moment-producing mechanism 23. The upper moment-producing mechanism 21 and the lower moment-producing mechanism 23 may each provide an input into a crankshaft 25 to rotate the crankshaft 25 about axis A. Each mechanism 21, 23 may have a single or multiple separate linkages that produce the moment on the crankshaft 25. For example, the upper moment-producing mechanism 21 may include one or more upper linkages extending from the handles 34 to the crankshaft 25. The lower moment-producing mechanism 23 may include one or more lower linkages extending from the pedal 32 to the crankshaft 25. In one example, the machine 10 may include left and right upper linkages, each including a plurality of links configured to connect an input end (e.g., a handle end) of an upper linkage to the crankshaft 25. Likewise, the machine 10 may include left and right lower linkages, each including a plurality of links configured to connect an input end (e.g., a pedal end) of a lower linkage to the crankshaft 25. The crankshaft 25 may have a first side and a second side and may be rotatable about the crankshaft axis A. The first side of the crankshaft may be connected, for example, to the left upper and lower linkages, and the second side of the crankshaft may be connected, for example, to the right upper and lower linkages.

In various embodiments, the lower moment-producing mechanism 23 may include a first lower linkage and a second lower linkage corresponding to a left and right side of the machine 10. Each of the first and second lower linkages may include one or more links operatively arranged to transform a force input from the user (e.g., from the lower body of the user) into a moment about the crankshaft 25. For example, the first and second lower linkages may include one or more of first and second pedals 32, first and second rollers 30, first and second lower reciprocating members 26 (also referred to as foot members or foot links 26), and/or first and second crank arms 28, respectively. The first and second lower linkages may operably transmit a force input from the user into a moment about the crankshaft 25. For example, the pedals 32 may provide an input into the crankshaft wheel 25 through a lower linkage of the first and second lower reciprocating member 26 and the first and second crank arms 28.

The machine 10 may include a crank wheel 24 which may be rotatably supported by the frame 12 (for example at the connection of the lower support structure 16 to the upper support structure 20) about the crank axis A. The first and second crank arms 28 may be fixed relative to the crankshaft 25, which in turn may be fixed relative to the crank wheel 24. The crank arms 28 may be positioned on opposite sides of the crank wheel 24. The crank arms 28 may be rotatable about the crank axis A, such that rotation of the crank arms 28 causes the crankshaft 25 and the crank wheel 24 to rotate about the crank axis A. The first and second crank arms 28 may extend from the crankshaft 25 (e.g., from axis A) in opposite radial directions to their respective radial ends. For example, the first side and the second side of the crankshaft 25 may be fixedly connected to the output ends of the first and second crank arms 28 and the input ends of each crank arm 28 may extend radially from the connection between the respective crank arm 28 and the crankshaft 25. First and second lower reciprocating members 26 may have forward ends (i.e., output ends) that are pivotally coupled to the radial ends (i.e., input ends) of the first and second crank arms 28, respectively. The rearward ends (i.e., input ends) of the first and second lower reciprocating members 26 may be coupled to first and second foot pedals 32, respectively. The rearward ends (i.e., input ends) of the first and second lower reciprocating members 26 may thus be interchangeably referred to as pedal ends.

One or more rollers 30 may be coupled to the first and second lower reciprocating members 26, respectively. For example, the one or more rollers 30 may be coupled to first and second lower reciprocating members 26 proximate the first and second pedals 32 (for example, the one or more rollers 30 may extend from forward ends of the first and second pedals 32. The first and second pedals 32 may be operable for a user to stand on and provide an input force to the first and second lower reciprocating members 26. The rollers 30 may rotate on and travel along the inclined members 22. For example, the rollers 30 may rollingly translate along the inclined members 22 of the frame 12 to define a travel path for the rollers 30. Referring to FIG. 1, a pair of rollers 30 and an axle 33 may be provided for each lower reciprocating member 26. The rollers 30 may travel along separate inclined members 22, which may be spaced apart from one another and coupled together by cross braces 18, 36. The cross braces 18, 36 may be coupled with opposing ends of the inclined members 22. One cross brace 18 may couple upper ends of the inclined members 22 to the lower support structure 16, and the other cross brace 36 may couple lower ends of the inclined members 22 to the base 14. In some embodiments, a single roller 30 is provided for each lower reciprocating member 26. In alternative embodiments, other bearing mechanisms may be used to provide translational motion of the lower reciprocating members 26 along the inclined members 22 instead of or in addition to the rollers 30, such as sliding friction-type bearings.

When the foot pedals 32 are driven by a user, the pedal ends of the lower reciprocating members 26 (also referred to as foot members 26) may translate in a substantially linear path via the rollers 30 along the inclined members 22. In alternative embodiments, the inclined members 22 may include a non-linear portion, such as a curved or bowed portion, such that the pedal ends of the lower reciprocating members 26 translate in non-linear path via the rollers 30 along the non-linear portion of the inclined members. In these embodiments, the non-linear portion of the inclined members may have any curvature, such as a curvature of a constant or non-constant radius, and may include convex, concave, and/or partially linear surfaces for the rollers 30 to travel along. In some embodiments, the non-linear portion of the inclined members may have an average angle of inclination of at least 45°, and/or may have a minimum angle of inclination of at least 45°, relative to a horizontal ground plane.

The forward (i.e., output ends) of the foot members 26 may move in circular paths about the crank axis A, which circular motion may drive the crank arms 28 and the crank wheel 24 in a rotational motion about axis A. The circular movement of the output ends of the foot members 26 may cause the pedals 32 to pivot as the rollers 30 translate along the inclined members 22. The combination of the circular motion of the output ends of the lower reciprocating members 26, the linear motion of the pedal ends along the inclined member 22, and the pivotal motion of the pedals 32 may cause the pedals 32 to move in non-circular closed loop paths, such as substantially ovular and/or substantially elliptical closed loop paths. For example, with reference to FIG. 7A, a point F at the front of the pedals 32 may traverse a path 60 and a point R at the rear of the pedals may traverse a path 62.

Figure 7A:
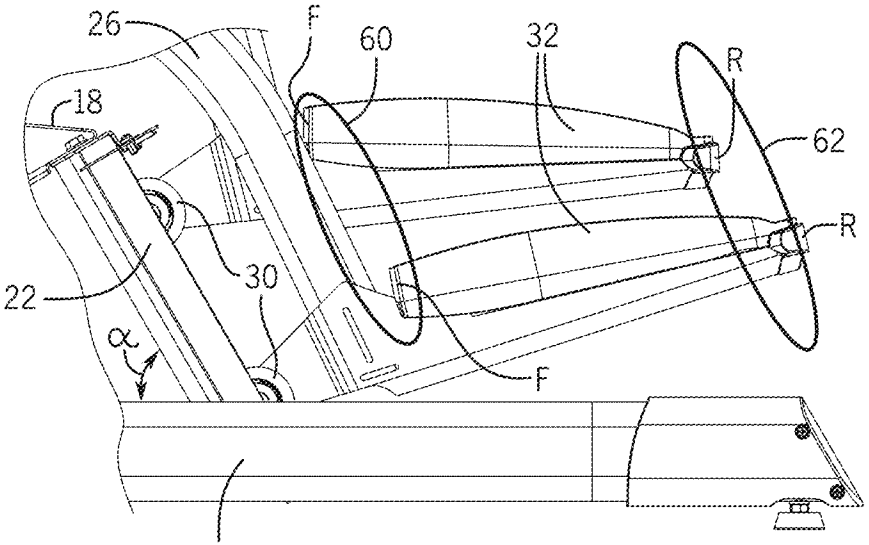
FIG. 7A is an enlarged view of a portion of FIG. 7, showing closed loop paths traversed by foot pedals of the machine.
Figure 7:
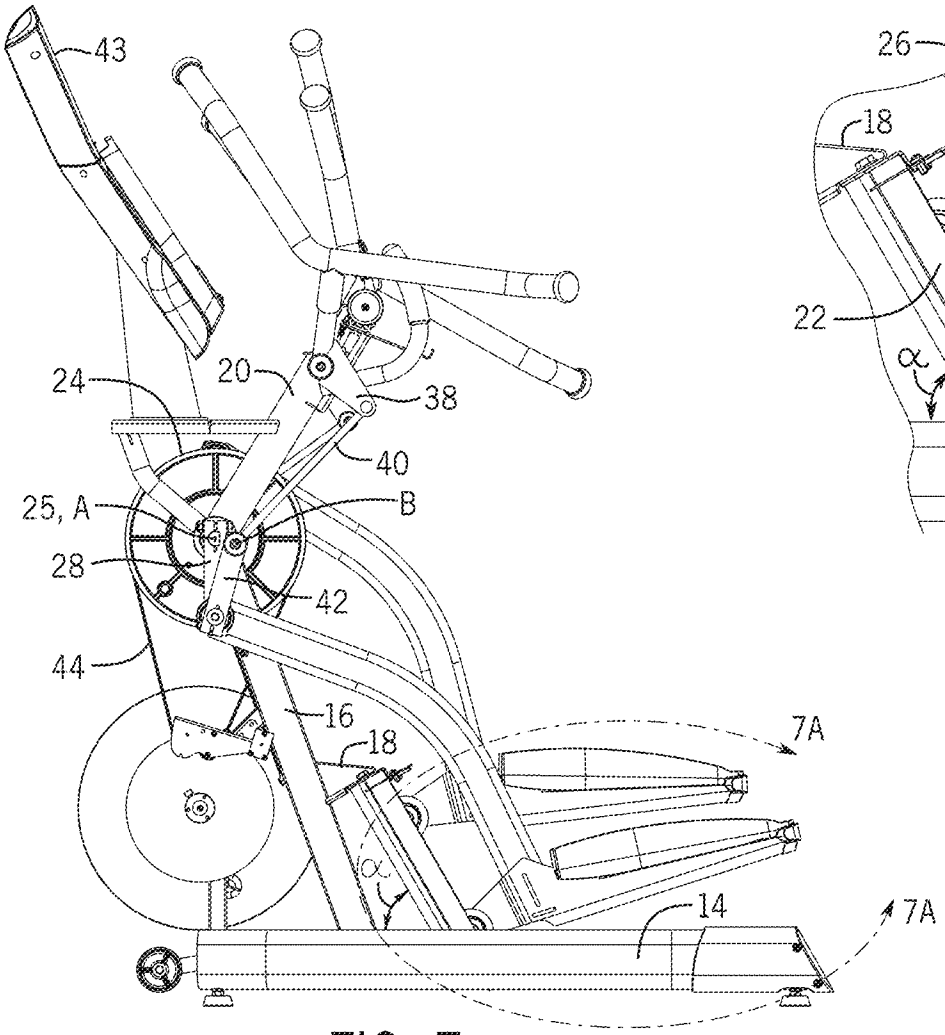
FIG. 7 is a left side view of the machine of FIG. 1.

The closed loop paths traversed by different points on the foot pedals 32 may have different shapes and sizes, such as with the more rearward portions of the pedals 32 traversing longer distances. For example, the path 60 may be shorter and/or narrower than the path 62. A closed loop path traversed by the foot pedals 32 may have a major axis defined by the two points of the path that are furthest apart. The major axis of one or more of the closed loop paths traversed by the pedals 32 may have an angle of inclination closer to vertical than to horizontal, such as at least 45°, at least 50°, at least 55°, at least 60°, at least 65°, at least 70°, at least 75°, at least 80°, and/or at least 85°, relative to a horizontal plane defined by the base 14. As shown in FIG. 7, to cause such inclination of the closed loop paths of the pedals, the inclined members 22 may include a substantially linear portion over which the rollers 30 traverse. The inclined members 22 may form a large angle of inclination a relative to the horizontal base 14, such as at least 45°, at least 50°, at least 55°, at least 60°, at least 65°, at least 70°, at least 75°, at least 80°, and/or at least 85°. This large angle of inclination which sets the path for the foot pedal motion may provide a user with a lower body exercise more akin to climbing than to walking or running on a level surface. Such a lower body exercise may be similar to that provided by a traditional stair climbing machine.

In various embodiments, the upper moment-producing mechanism 21 may include a first upper linkage and a second upper linkage corresponding to a left and right side of machine 10. Each of the first and second upper linkages may include one or more links operatively arranged to transform a force input from the user (e.g., from the upper body of the user) into a moment about the crankshaft 25. For example, the first and second upper linkages may include one or more of first and second handles 34, first and second links 38, first and second upper reciprocating members 40, and/or first and second intermediate crank arms or links 42, respectively. The first and second upper linkages may operatively transmit a force input from the user, at the handles 34, into a moment about the crankshaft 25. For example, the handles 34 may provide an input into the crankshaft 25 through an upper linkage of the first and second links 38, the first and second reciprocating members 40, and the first and second intermediate crank arms 42. Rotation of the crankshaft 25 may cause the upper and lower linkages of the machine 10 to move relative to each other. The first and second handles 34 may be pivotally coupled to the frame 12, such as the upper support structure 20, and may pivot about a horizontal axis D (see FIG. 4A). The machine 10 may include first and second handles 35 fixedly coupled to the frame 12, such as the upper support structure 20, for a user to grasp with their hands while exercising their legs.

With reference to FIGS. 1-5A and 7, the handles 34 may be rigidly connected to the input end of respective first and second links 38 such that reciprocating pivotal movement of the handles 34 about the horizontal axis D causes corresponding reciprocating pivotal movement of the first and second links 38 about the horizontal axis D. For example, the first and second links 38 may be cantilevered off of the first and second handles 34 at the pivot aligned with pivot axis D. Each of the first and second links 38 may form angle ω with the respective handles 34. The angle ω may be measured from a plane passing through the axis D and the curve in the handle 34 proximate the connection to the link 38. The angle ω may be any angle such as angles between 0 and 180 degrees. The angle ω may be an angle that is most comfortable to a single user or an average user. In some embodiments, the first and second links 38 may be formed integrally with the first and second handles 34, respectively. The first and second links 38 may be referred to as first and second extensions 38 of the first and second handles 34.

Figure 4:
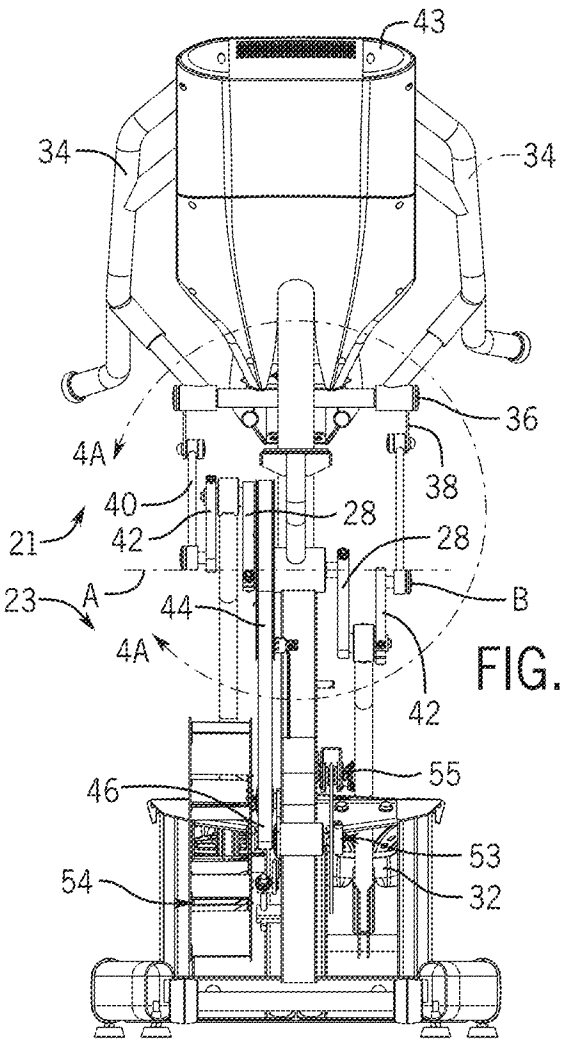
FIG. 4 is a front view of the machine of FIG. 1.
Figure 4A:
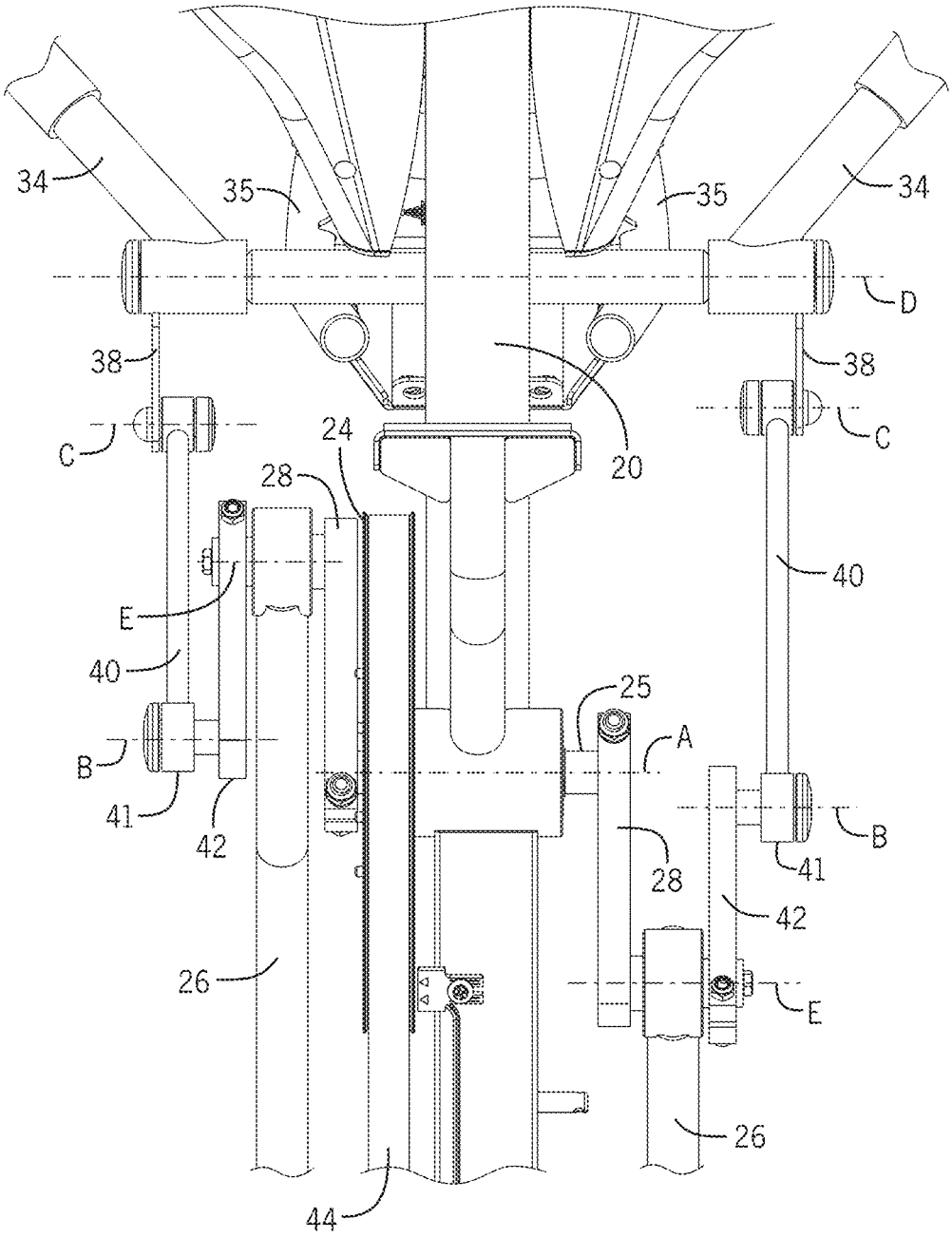
FIG. 4A is an enlarged view of a portion of FIG. 4.
Figure 6:
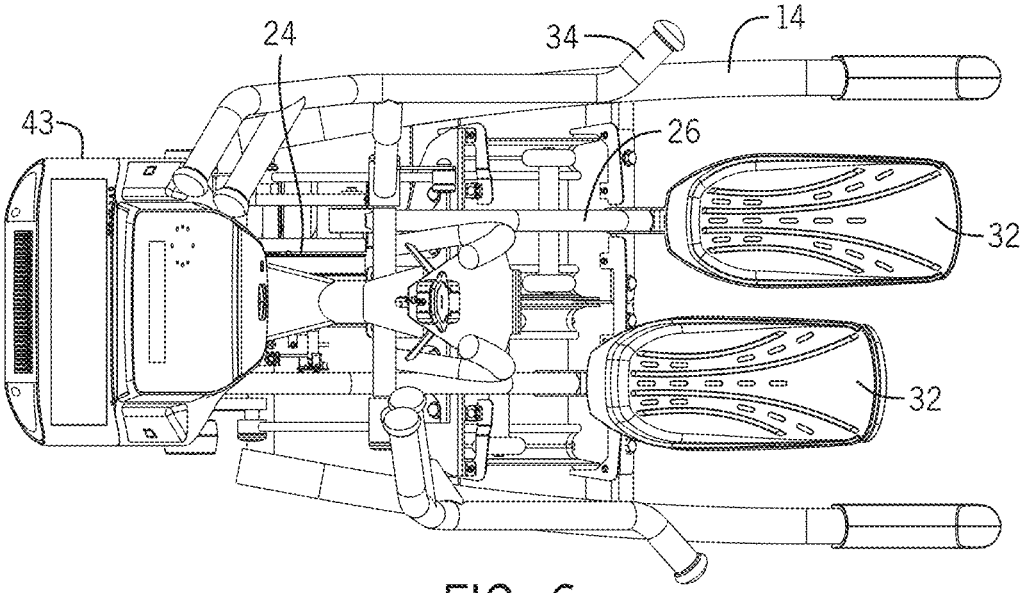
FIG. 6 is a top view of the machine of FIG. 1.

The first and second links 38 may be pivotally coupled at their radial ends (i.e., output ends) to the first and second upper reciprocating members 40, respectively, to permit relative pivotal motion between the links 38 and the upper reciprocating members 40. The first and second upper reciprocating members 40 may be formed as rigid links. With reference to FIG. 4A, upper ends of the upper reciprocating members 40 may be pivotally coupled to the links 38 at axis C. As the handles 34 articulate back and forth (i.e., reciprocate pivotally about axis D), the links 38 move in corresponding arcs about the pivot axis D, which in turn articulates the upper reciprocating members 40. As the upper ends of the upper reciprocating members 40 articulate back and forth about the pivot axis D, lower ends 41 of the upper reciprocating members 40 orbit around the crank axis A along a circular path having a radius defined by the distance between crank axis A and pivot axis B. In other words, pivot axes B, which are defined at the pivot connection of the first and second upper reciprocating members 40 to the first and second intermediate crank arms 42, respectively, circularly orbit around crank axis A. The orbiting axes B may be parallel to the fixed crank axis A and offset radially in opposite directions from the fixed crank axis A (see FIGS. 4A and 5A). Each axis B may be located proximal to an end of a respective upper reciprocating member 40 and intermediate crank arm 42.

Figure 5:
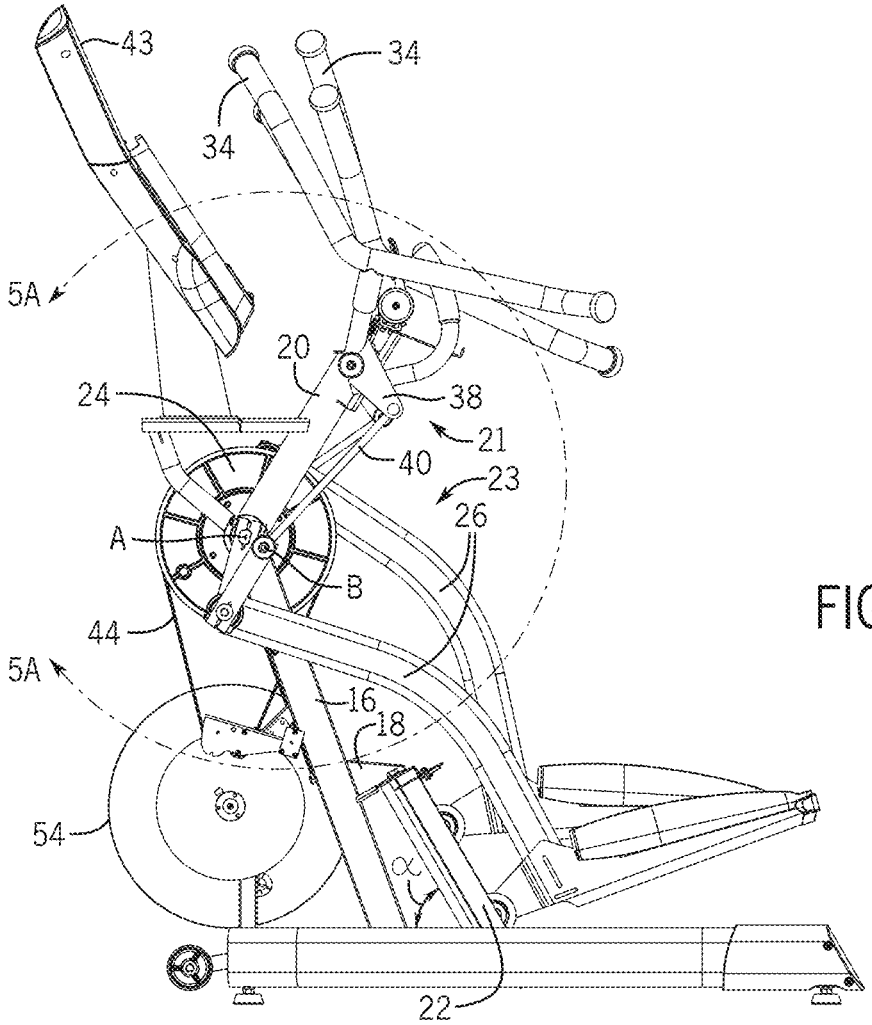
FIG. 5 is a left side view of the machine of FIG. 1.
Figure 5A:
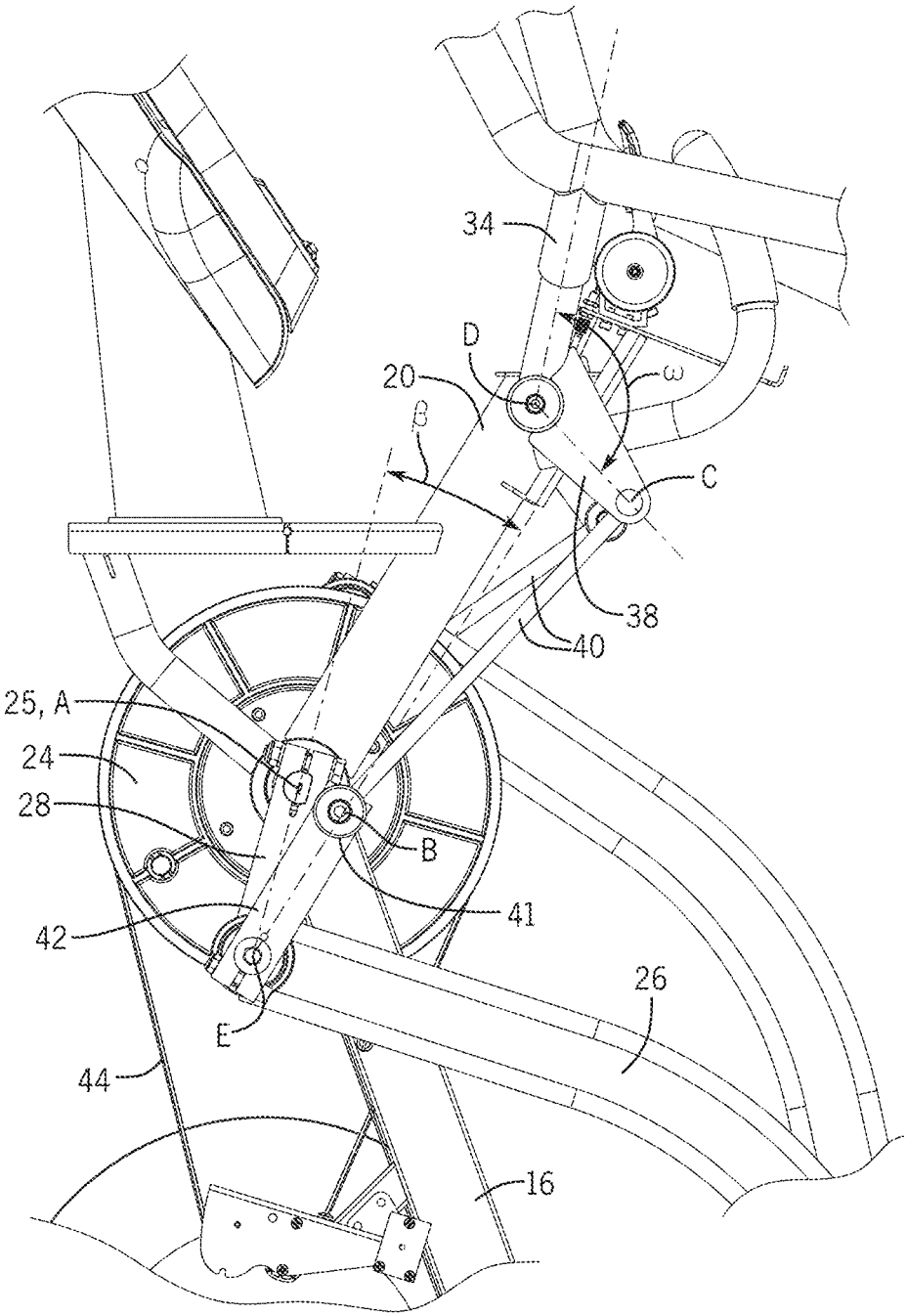
FIG. 5A is an enlarged view of a portion of FIG. 5.

As shown in FIGS. 4A and 5A, the first and second intermediate crank arms 42 may be pivotally coupled to the first and second upper reciprocating members 40, respectively, at axes B, and to the first and second lower reciprocating members 26, respectively, at axes E. The first and second intermediate crank arms 42 may be oriented perpendicular to axes B and E. As shown in FIG. 4A, the first and second intermediate crank arms 42 may be positioned inside of the first and second upper reciprocating members 40, respectively, and outside of the first and second lower reciprocating members 26, respectively. The first and second lower reciprocating members 26 may be positioned outside of the first and second crank arms 28, respectively.

With continued reference to FIGS. 2A-2D, 4A, and 5A, the first and second intermediate crank arms 42 may be fixed relative to the first and second crank arms 28, respectively, such that respective crank arms 28, 42 rotate in unison around the crank axis A to rotate the crank wheel 24 and the crankshaft 25 when the pedals 32 and/or the handles 34 are driven by a user. As shown in FIG. 5A, respective cranks arms 28, 42 may be fixedly coupled to each other at axes E to define a fixed angle β between the respective crank arms 28, 42. In some examples, the angle β formed between the respective crank arm 28 and intermediate crank arm 42 may be in the range of approximately 0° to 30° (see FIG. 5A).

When the pedals 32 and/or the handles 34 are driven by a user, the crank axes B and E orbit about the crank axis A. With reference to FIGS. 4A and 5A, as the crank wheel 24 and the crankshaft 25 rotate about the crank axis A, the reciprocating axes B and E move in circular orbits of different radii about the crank axis A. The distance between crank axis A and each axis B defines the length of the moment arm of each intermediate crank arm 42 which exerts a moment on the crankshaft 25, and this moment arm may be considered a virtual crank arm. The distance between crank axis A and each axis E defines the length of the moment arm of each crank arm 28 which exerts a moment on the crankshaft 25. As illustrated in FIG. 5, the distance between crank axis A and each axis E is larger than the distance between crank axis A and each axis B, resulting in the crank arms 28 applying a larger moment on the crankshaft 25 than the intermediate crank arms 42.

The upper linkage assemblies of the machine 10 may be configured in accordance with the examples herein to cause the handles 34 to reciprocate in opposition to the pedals 32 such as to mimic the kinematics of natural human motion. For example, as the left pedal 32 is moving upward and forward, the left handle 34 pivots rearward, and vice versa. The machine 10 may include a user interface mounted near the top of the upper support member 20. The user interface may include a display 43 to provide information to the user, and may include user inputs to allow the user to enter information and to adjust settings of the machine, such as to adjust the resistance.

Referring now further to FIGS. 2A-2D, the upper moment-producing mechanism 21 of the machine 10 may be configured to produce a first mechanical advantage. As illustrated in FIGS. 2A-2D, the handles 34 pivot about axis D in response to force being exerted against the handles 34 by a user. The pivotal motion of the links 38, which are fixedly connected to the handles 34, causes the upper reciprocating members 40 to drive the intermediate crank arms 42 about the crank axis A. The intermediate crank arms 42 may be pivotally connected to the first and second lower reciprocating members 26 and fixedly connected to the crank arms 28 at axes E, and thus the intermediate crank arms 42 drive the crank arms 28, which rotate the crankshaft 25 about crank axis A. During rotation of the crankshaft 25, the axes B travel around the crank axis A in a circular path with the distance between axes B and crank axis A defining the effective moment arm of the intermediate crank arms 42. In other words, a virtual crank arm may be defined between axis A and axis B. Freedom of relative rotational movement between the ends 41 of the upper reciprocating members 40 and the intermediate crank arms 42 permits the circular motion of the axes B about crank axis A.

FIGS. 2A-2D show the intermediate crank arms 42 in different positions around the crank axis A. The different positions of the intermediate crank arms 42 represent rotation of the crankshaft 25 which is fixedly attached to the intermediate crank arms 42 through the crank arms 28. Due to the fixed attachment, the intermediate crank arms 42 transmit a force received from the first and second handles 34 to the crankshaft 25. As previously discussed, the intermediate crank arms 42 may be fixedly positioned relative to the crank arms 28. For example, as shown in FIG. 5A, the intermediate crank arms 42 may be set at a fixed angle β relative to the crank arms 28. As the upper reciprocating members 40 and the crank arms 28 rotate, for example 90 degrees, the crank arms 28 may stay at the same relative angle to the intermediate crank arms 42. The angle β may be any angle (i.e., 0-360 degrees). In some examples, the angle β may be between 0° and 30° (see FIG. 5A). In one example, the angle β may be 15°.

The upper moment-producing mechanism 21 of the machine 10 may be configured to produce a second mechanical advantage. As illustrated in FIGS. 2A-2D, the pedals 32 pivot around the rollers 30 in response to force being exerted against the first and second lower reciprocating members 26 through the pedals 32. The force on the first and second lower reciprocating members 26 drives the first and second crank arms 28, respectively. The crank arms 28 are pivotally connected at axes E to the first and second lower reciprocating members 26 and fixedly connected to the crankshaft 25 at axis A. As the first and second lower reciprocating members 26 are articulated, the force exerted on the pedals 32 drives the crank arms 28, which rotate the crankshaft 25 about axis A. FIGS. 2A-2D show the crank arms 28 in different positions around the crank axis A. The different positions of the crank arms 28 represent rotation of the crankshaft 25 which is fixedly attached to the crank arms 28. Due to the fixed attachment, the crank arms 28 transmit a force received from the first and second lower reciprocating members 26 to the crankshaft 25.

The mechanical advantage of the upper and lower moment-producing linkages or mechanisms 21, 23 may be manipulated by altering the characteristics of the various elements. For example, in the upper moment-producing linkage or mechanism 21, the leverage applied by the handles 34 may be established by length of the handles or the location from which the handles 34 receive the input from the user. The leverage applied by the first and second links 38 may be established by the distance from axis D to axis C. The leverage applied by the intermediate crank arms 42 may be established by the distance between axis B and axis A. The upper reciprocating members 40 may connect the first and second links 38 to the intermediate crank arms 42 over the distance from axis C to axis B. The ratio of the distance between axes D and C compared to the distance between axes B and A (i.e., D-C:B-A) may be, in one example, between 1:4 and 4:1. In another example, the ratio may be between 1:1 and 4:1. In another example, the ratio may be between 2:1 and 3:1. In another example, the ratio may be about 2.8:1. Similar ratios may apply to the ratio of axis B to axis A compared to axis A to axis E (i.e., B-A:A-E).

The upper moment-producing mechanism 21 and the lower moment-producing mechanism 23, functioning together or separately, transmit input by the user at the handles 34 and/or the pedals 32 to a rotational movement of the crankshaft 25. In accordance with various embodiments, the upper moment-producing mechanism 21 drives the crankshaft 25 with a first mechanical advantage (e.g., as a comparison of the input force to the moment at the crankshaft). The first mechanical advantage may vary throughout the cycling of the handles 34. For example, as the first and second handles 34 reciprocate back and forth around axis D through the cycle of the machine, the mechanical advantage supplied by the upper moment-producing mechanism 21 to the crankshaft 25 may change with the progression of the cycle of the machine. The lower moment-producing mechanism 23 drives the crankshaft 25 with a second mechanical advantage (e.g., as a comparison of the input force at the pedals 32 to the torque at the crankshaft 25 at a particular instant or angle). The second mechanical advantage may vary throughout the cycle of the pedals 32 as defined by the vertical position of the rollers 30 relative to their top vertical and bottom vertical position. For example, as the pedals 32 change position, the mechanical advantage supplied by the lower moment-producing mechanism 23 may change with the changing position of the pedals 32. The various mechanical advantage profiles may rise to a maximum mechanical advantage for the respective moment-producing mechanisms at certain points in the cycle and may fall to minimum mechanical advantages at other points in the cycle, In this respect, each of the moment-producing mechanisms 21, 23 may have a mechanical advantage profile that describes the mechanical effect across the entire cycle of the handles 34 and/or pedals 32. The first mechanical advantage profile may be different than the second mechanical advantage profile at any instance in the cycle and/or the profiles may generally be different across the entire cycle. The exercise machine 10 may be configured to balance the user's upper body workout (e.g. at the handles 34) by utilizing the first mechanical advantage differently as compared to the user's lower body workout (e.g. at the pedals 32) utilizing the second mechanical advantage. In various embodiments, the upper moment-producing mechanism 21 may substantially match the lower moment-producing mechanism 23 at such points where the respective mechanical advantage profiles are near their respective maximums. Regardless of difference or similarities in respective mechanical advantage profiles throughout the cycling of the exercise machine, the inputs to the handles 34 and pedals 32 still work in concert through their respective mechanisms to drive the crankshaft 25.

The exercise machine 10 may include a resistance mechanism operatively arranged to resist the rotation of the crankshaft 25. In some embodiments, the exercise machine 10 may include one or more resistance mechanism such as an air-resistance based resistance mechanism, a magnetism based resistance mechanism, a friction based resistance mechanism, and/or other resistance mechanisms. The crank wheel 24 may be coupled to one or more resistance mechanisms to provide resistance to the reciprocating motion of the pedals 32 and handles 34. For example, resistance may be applied via an air brake, a friction brake, a magnetic brake, or the like. As shown in FIGS. 1-2D and 4, the machine 10 may include an air-resistance based resistance mechanism, such as air brake 54, rotationally coupled to the frame 12. The machine 10 may additionally or alternatively include a magnetic-resistance based resistance mechanism, or magnetic brake 53 (see e.g., FIG. 1-4). The rotor 50 and the air brake 54 may be driven by rotation of the crankshaft 25 and each may be operable to resist the rotation of the crankshaft 25. In the illustrated embodiment, the rotor 50 and the air brake 54 are driven by a belt or chain 44 that is routed around the crank wheel 24 and a pulley 46 (see, e.g., FIG. 3). The ratio of the diameters of the crank wheel 24 and the pulley 46 may be used as a gearing mechanism to adjust the ratio of the angular velocity of the rotor 50 and the air brake 54 to the angular velocity of the crank wheel 24. For example, one rotation of the crank wheel 24 may cause several rotations of the rotor and/or the air brake 54 to increase the resistance provided by the resistance mechanism. In addition, a tensioner or idler system may be used to take up extra slack in the belt or chain 44 and to increase the wrap angle of the belt or chain 44 about the crank wheel 24 and/or the pulley 46.

One or more of the resistance mechanisms can be adjustable to provide different levels of resistance at a given reciprocation frequency. Further, one or more of the resistance mechanisms can provide a variable resistance that corresponds to the reciprocation frequency of the exercise machine, such that resistance increases as reciprocation frequency increases. For example, one reciprocation of the pedals 32 and/or handles 34 may cause several rotations of the rotor 50 and/or air brake 54 to increase the resistance provided by the magnetic brake 53 and/or air brake 54. The air brake 54 may be adjustable to control the volume of air flow that is induced to flow through the air brake at a given angular velocity in order to vary the resistance provided by the air brake.

The air brake 54 may include a radial fin structure that causes air to flow through the air brake when it rotates. For example, rotation of the air brake 54 may cause air to enter through lateral openings on the lateral side of the air brake near the rotation axis and exit through radial outlets opening to a radial perimeter of the air brake. The induced air motion through the air brake 54 may cause resistance to the rotation of the crank wheel 24 and thus crankshaft 25, which is transferred to resistance to the reciprocating motions of the pedals 32 and handles 34. As the angular velocity of the air brake 54 increases, the resistance force may increase in a non-linear relationship, such as a substantially exponential relationship.

In some embodiments (not shown), an air brake may include an inlet plate that is adjustable in an axial direction (and optionally also in a rotational direction). An axially adjustable inlet plate may be configured to move in a direction parallel to the rotation axis of the air brake. For example, when the inlet plate is further away axially from the air inlet(s), increased air flow volume is permitted, and when the inlet plate is closer axially to the air inlet(s), decreased air flow volume is permitted. In some embodiments (not shown), an air brake may include an air outlet regulation mechanism that is configured to change the total cross-flow area of the air outlets at the radial perimeter of the air brake, in order to adjust the air flow volume induced through the air brake at a given angular velocity.

In some embodiments, the air brake 54 may include an adjustable air flow regulation mechanism, such as the inlet plate or other mechanism described herein, that can be adjusted rapidly while the machine 10 is being used for exercise. For example, the air brake 54 may include an adjustable air flow regulation mechanism that can be rapidly adjusted by the user while the user is driving the rotation of the air brake, such as by manipulating a manual lever, a button, or other mechanism positioned within reach of the user's hands while the user is driving the pedals 32 with the user's feet. Such a mechanism may be mechanically and/or electrically coupled to the air flow regulation mechanism to cause an adjustment of air flow and thus adjust the resistance level. In some embodiments, such a user-caused adjustment may be automated, such as using a button or mechanism 57 on a console near the handles 34 coupled to a controller and an electrical motor coupled to the air flow regulation mechanism. In other embodiments, such an adjustment mechanism may be entirely manually operated, or a combination of manual and automated. In some embodiments, a user may cause a desired air flow regulation adjustment to be fully enacted in a relatively short time frame, such as within a fraction of a second or multiple seconds.

The magnetic brake 53 may include the rotor 50 rotationally coupled to the frame 12 and a brake caliper 55 coupled to the frame 12. The magnetic brake 53 may provide resistance to rotation of the crankshaft 25 by magnetically inducing eddy currents in the rotor 50 as the rotor rotates. The brake caliper 55 may include magnets positioned on opposite sides of the rotor 50. As the rotor 50 rotates between the magnets, the magnetic fields created by the magnets induce eddy currents in the rotor 50, producing resistance to the rotation of the rotor 50. To adjust resistance, the magnitude of the magnetic field may be varied (e.g., increased or decreased) to an outer portion of the rotor 50. The magnitude of the resistance to rotation of the rotor 50 may increase as a function of the angular velocity of the rotor 50, such that higher resistance is provided at high reciprocation frequencies of the pedals 32 and handles 34. The magnitude of resistance provided by the magnetic brake 53 may also be a function of the radial distance from the magnets to the rotation axis of the rotor 50. As this radius increases, the linear velocity of the portion of the rotor 50 passing between the magnets increases at any given angular velocity of the rotor 50, as the linear velocity at a point on the rotor 50 is a product of the angular velocity of the rotor 50 and the radius of that point from the rotation axis. In some embodiments, the brake caliper 55 may be pivotally mounted, or otherwise adjustably mounted, to the frame 12 such that the radial position of the magnets relative to the rotation axis of the rotor 50 may be adjusted to move the magnets to different radial positions relative to the rotor 50 to change the resistance provided by the magnetic brake 53 at a given reciprocation frequency of the pedals 32 and handles 34.

In some embodiments, the brake caliper 55 may be adjusted rapidly while the machine 10 is being used for exercise to adjust the resistance. For example, the radial position of the magnets of the brake caliper 55 relative to the rotor 50 may be rapidly adjusted by the user while the user is driving the reciprocation of the pedals 32 and/or handles 34, such as by manipulating a lever 57, a button, or other mechanism positioned within reach of the user's hands (see e.g., FIG. 1) while the user is driving the pedals 32 with the user's feet. Such an adjustment mechanism may be mechanically and/or electrically coupled to the magnetic brake 53 to cause an adjustment of eddy currents in the rotor 50 and thus adjust the magnetic resistance level. The user interface 43 may include a display to provide information to the user, and may include user inputs to allow the user to enter to adjust settings of the machine, such as to adjust the resistance. In some embodiments, such a user-caused adjustment can be automated, such as using a button on the user interface 43 that is electrically coupled to a controller and an electrical motor coupled to the brake caliper 53. In other embodiments, such an adjustment mechanism may be entirely manually operated, or a combination of manual and automated. In some embodiments, a user may cause a desired magnetic resistance adjustment to be fully enacted in a relatively short time frame, such as within a half-second, within one second, within two seconds, within three second, within four seconds, and/or within five seconds from the time of manual input by the user via an electronic input device or manual actuation of a mechanical device. In other embodiments, the magnetic resistance adjustment time periods can be smaller or greater than the time periods provided above.

The exercise machine 10 shown in FIGS. 1-7A may include an outer housing (not shown) positioned around a front portion of the machine. The housing may house and protect portions of the frame 12, the pulley 46, the belt or chain 44, lower portions of the upper reciprocating members 40, the air brake 54, the magnetic brake 53, motors for adjusting the air brake and/or magnetic brake, wiring, and/or other components of the machine 10. The housing may include an air brake enclosure that includes lateral inlet openings to allow air into the air brake 54 and radial outlet openings to allow air out of the air brake. The housing may include a magnetic brake enclosure to protect the magnetic brake 53, where the magnetic brake is included in addition to or instead of the air brake 54. The crank wheel 24, crank arms 28, and/or intermediate crank arms 42 may be exposed through the housing such that the upper and lower reciprocating members 40, 26 can drive the respective components in a circular motion about the axis A without obstruction by the housing.

Embodiments that include a variable resistance mechanism that provide increased resistance at higher angular velocity and a rapid resistance mechanism that allow a user to quickly change the resistance at a given angular velocity allow the machine 10 to be used for high intensity interval training. In an exercise method, a user can perform repeated intervals alternating between high intensity periods and low intensity periods. High intensity periods can be performed with the adjustable resistance mechanism, such as the magnetic braking system 53 and/or the air brake 54, set to a low resistance setting (e.g., with the inlet plate blocking air flow through the air brake 54). At a low resistance setting, the user can drive the pedals 32 and/or handles 34 at a relatively high reciprocation frequency, which can cause increased energy exertion because, even though there is reduced resistance from the air brake 54, the user is caused to lift and lower his own body weight a significant distance for each reciprocation, like with a traditional stair climber machine. The rapid climbing motion can lead to an intense energy exertion. Such a high intensity period can last any length of time, such as less than one minute, or less than 30 seconds, while providing sufficient energy exertion as the user desires.

Low intensity periods can be performed with the adjustable resistance mechanism, such as the magnetic braking system 53 and/or the air brake 54, set to a high resistance setting (e.g., with the inlet plate allowing maximum air flow through the air brake 54). At a high resistance setting, the user can be restricted to driving the pedals 32 and/or handles 34 only at relatively low reciprocation frequencies, which can cause reduced energy exertion because, even though there is increased resistance from the air brake 54, the user does not have to lift and lower his own body weight as often and can therefor conserve energy. The relatively slower climbing motion can provide a rest period between high intensity periods. Such a low intensity period or rest period can last any length of time, such as less than two minutes, or less than about 90 seconds. An exemplary interval training session can include any number of high intensity and low intensity periods, such less than 10 of each and/or less than about 20 minutes total, while providing a total energy exertion that requires significantly longer exercise time, or is not possible, on a traditional stair climber or a traditional elliptical machine.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the terms "a", "an" and "at least one" encompass one or more of the specified element. That is, if two of a particular element are present, one of these elements is also present and thus "an" element is present. The terms "a plurality of" and "plural" mean two or more of the specified element.

As used herein, the term "and/or" used between the last two of a list of elements means any one or more of the listed elements. For example, the phrase "A, B, and/or C" means "A," "B," "C," "A and B," "A and C," "B and C" or "A, B and C."

All relative and directional references (including: upper, lower, upward, downward, left, right, leftward, rightward, top, bottom, side, above, below, front, middle, back, vertical, horizontal, height, depth, width, and so forth) are given by way of example to aid the reader's understanding of the particular embodiments described herein. They should not be read to be requirements or limitations, particularly as to the position, orientation, or use of the invention unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Unless otherwise indicated, all numbers expressing properties, sizes, percentages, measurements, distances, ratios, and so forth, as used in the specification or claims are to be understood as being modified by the term "about." Accordingly, unless otherwise indicated, implicitly or explicitly, the numerical parameters set forth are approximations that may depend on the desired properties sought and/or limits of detection under standard test conditions/methods. When directly and explicitly distinguishing embodiments from discussed prior art, numbers are not approximations unless the word "about" is recited.

In view of the many possible embodiments to which the principles disclosed herein may be applied, it should be recognized that the illustrated embodiments are only examples and should not be taken as limiting the scope of the disclosure. Rather, the scope of the disclosure is at least as broad as the following exemplary claims.

The invention claimed is:

1. A stationary exercise machine comprising:

a frame;

a crankshaft coupled with the frame and rotatable about a crankshaft axis;

first and second crank arms rigidly coupled with respective opposite sides of the crankshaft, wherein rotation of at least one of the first or second crank arms causes rotation of the crankshaft about the crankshaft axis;

first and second intermediate crank arms rigidly coupled with the first and second crank arms, respectively; and first and second handles operatively coupled with the first and second intermediate crank arms, respectively, at respective pivot axes to convert a user's input force at the first and second handles into a moment on the crankshaft, wherein the respective pivot axes are spaced a distance from the crankshaft axis and orbit the crankshaft axis to define respective virtual crank arms extending between the respective pivot axes and the crankshaft axis.

2. The stationary exercise machine of claim 1, wherein the first and second intermediate crank arms are angularly offset from the first and second crank arms, respectively, to define an angle between the first and second intermediate crank arms and the first and second crank arms, respectively.

3. The stationary exercise machine of claim 1, wherein the angle comprises about 15 degrees.

4. The stationary exercise machine of claim 1, further comprising first and second upper reciprocating members pivotally coupled with the first and second intermediate crank arms, respectively, at the respective pivot axes and pivotally coupled with the first and second handles, respectively.

5. The stationary exercise machine of claim 4, wherein:

the first and second intermediate crank arms are positioned laterally inside of the first and second upper reciprocating members; and the first and second crank arms are positioned laterally inside of the first and second intermediate crank arms.

6. The stationary exercise machine of claim 4, wherein the first reciprocating member is pivotally coupled with a first extension of the first handle and the second upper reciprocating member is pivotally coupled with a second extension of the second handle.

7. The stationary exercise machine of claim 4, wherein the first and second upper reciprocating members comprise first and second rigid links, respectively.

8. The stationary exercise machine of claim 1, wherein the moment comprises a first moment and the respective pivot axes comprise respective first pivot axes, and further comprising first and second pedals operatively coupled with the first and second crank arms, respectively, at respective second pivot axes to convert a user's input force at the first and second pedals into a second moment on the crankshaft.

9. The stationary exercise machine of claim 8, wherein the second moment is larger than the first moment.

10. The stationary exercise machine of claim 8, further comprising first and second lower reciprocating members pivotally coupled with the first and second crank arms, respectively, at the respective second pivot axes, and coupled with the first and second pedals, respectively, at a location distal from the respective second pivot axes.

11. The stationary exercise machine of claim 10, wherein the first and second lower reciprocating members are positioned laterally between the first and second crank arms and the first and second intermediate crank arms, respectively.

12. The stationary exercise machine of claim 10, further comprising:

first and second inclined members coupled with the frame; and first and second pairs of rollers coupled with the first and second lower reciprocating members, respectively, wherein the first and second pairs of rollers travel along a length of the first and second inclined members, respectively.

13. The stationary exercise machine of claim 12, wherein:

the first and second pairs of rollers each include first and second rollers coupled together with an axle; and the first and second rollers of the first and second pairs of rollers travel along separate inclined members of the first and second inclined members, respectively.

14. The stationary exercise machine of claim 1, wherein:

the first and second crank arms each include a first end rigidly coupled with the crankshaft and a second end spaced from the crankshaft axis; and the first and second intermediate crank arms each include a first end rigidly coupled with the second end of a respective crank arm of the first and second crank arms, and a second end defining a respective pivot axis of the respective pivot axes.

15. The stationary exercise machine of claim 14, further comprising first and second upper reciprocating members each including a first end pivotally coupled with the second end of a respective intermediate crank arm of the first and second intermediate crank arms, and a second end pivotally coupled to a respective handle of the first and second handles.

16. The stationary exercise machine of claim 14, further comprising first and second lower reciprocating members each including a forward end pivotally coupled with the second end of a respective crank arm of the first and second crank arms and the first end of a respective intermediate crank arm of the first and second intermediate crank arms.

17. The stationary exercise machine of claim 16, wherein the forward ends of the first and second lower reciprocating members are positioned laterally between the second ends of the first and second crank arms and the first ends of the first and second intermediate crank arms, respectively.

18. The stationary exercise machine of claim 16, further comprising first and second pedals coupled with rearward ends of the first and second lower reciprocating members, respectively.

19. The stationary exercise machine of claim 1, further comprising a resistance mechanism operatively coupled with the crankshaft to resist rotation of the crankshaft about the crankshaft axis.

20. A stationary exercise machine comprising:

a frame;

a crankshaft coupled with the frame and rotatable about a crankshaft axis;

first and second handles pivotally coupled with the frame at a handle pivot axis;

first and second upper reciprocating members pivotally coupled with the first and second handles, respectively, at first pivot axes offset from the handle pivot axis;

first and second intermediate crank members pivotally coupled with the first and second reciprocating members, respectively, at reciprocating axes that orbit the crankshaft axis and define virtual crank arms extending between the crankshaft axis and the reciprocating axes;

first and second crank arms fixedly coupled with the first and second intermediate crank members, respectively, at crank axes, the first and second crank arms positioned laterally inside of the first and second intermediate crank members, respectively, and fixedly coupled with the crankshaft;

first and second lower reciprocating members pivotally coupled with the first and second crank arms, respectively, and the first and second intermediate crank arms, respectively, at the crank axes; and first and second foot pedals coupled with the first and second lower reciprocating members;

wherein:

the first and second handles are operatively coupled with the first and second intermediate crank arms, respectively, to convert a user's input force at the first and second handles into a first moment on the crankshaft; and the first and second foot pedals are operatively coupled with the first and second crank arms, respectively, to convert a user's input force at the first and second foot pedals into a second moment on the crankshaft that is different than the first moment.

* * * * *